US006413054B1

(12) United States Patent
Geiger et al.

(10) Patent No.: US 6,413,054 B1
(45) Date of Patent: Jul. 2, 2002

(54) FUEL INJECTION PUMP

(75) Inventors: Wolfgang Geiger, Remshalden; Walter Fuchs, Stuttgart; Hubert Greif, Markgroeningen; Stephan Jonas, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,916

(22) PCT Filed: Nov. 24, 1999

(86) PCT No.: PCT/DE99/03722

§ 371 (c)(1),
(2), (4) Date: Jul. 24, 2000

(87) PCT Pub. No.: WO00/32919

PCT Pub. Date: Jun. 8, 2000

(30) Foreign Application Priority Data

Nov. 24, 1998 (DE) ..... 198 54 766

(51) Int. Cl.[7] ..... F04B 1/06

(52) U.S. Cl. ..... 417/219; 417/221

(58) Field of Search ..... 417/219, 221

(56) References Cited

U.S. PATENT DOCUMENTS

| | | | | | |
|---|---|---|---|---|---|
| 2,680,412 | A | * | 6/1954 | Entwistle | 103/161 |
| 4,422,428 | A | * | 12/1983 | Eheim | 123/502 |
| 4,802,453 | A | * | 2/1989 | Thornthwaite | 123/450 |
| 5,059,096 | A | * | 10/1991 | Harris | 417/221 |
| 5,125,802 | A | * | 6/1992 | Nakamura et al. | 417/221 |
| 5,580,223 | A | * | 12/1996 | Bueser | 417/219 |
| 5,775,306 | A | * | 7/1998 | Wood | 123/502 |
| 5,810,569 | A | * | 9/1998 | Buckley et al. | 417/462 |

* cited by examiner

*Primary Examiner*—Charles G. Freay
*Assistant Examiner*—William Rodriguez
(74) *Attorney, Agent, or Firm*—Ronald E. Greigg

(57) ABSTRACT

A fuel injection pump having a cam drive and an injection adjuster piston, acting on the cam drive and serving the purpose of an injection onset adjustment. The injection adjuster piston on a face end encloses at least one pressure chamber that via a control valve is either made to communicate with a pressure source or a relief line or can be closed entirely. The control valve is actuated by an a proportional electromagnet. As a result, only a little adjusting medium is required, to obtain a high efficiency of the injection onset adjustment, and advantageously the injection adjuster piston is stressed only axially, and frictional forces on the circumference of the injection adjuster piston are thus avoided.

21 Claims, 2 Drawing Sheets

FUEL INJECTION PUMP

PRIOR ART

The invention is based on a fuel injection pump as set forth hereinafter. In one such fuel injection pump, known from German Published, Nonexamined Patent Application DE-OS 24 58 109, the control of the pressure in the pressure chamber enclosed in the cylinder by the injection adjuster piston is accomplished by a 2/3-way valve, which makes the pressure chamber communicate with either a pressurized oil feed pump or with a relief line. By means of the pressurized oil fed into the pressure chamber, the injection adjuster piston is displaced counter to the force of the spring, and the injection onset of the associated fuel injection pump is adjusted accordingly. The control is effected such that the injection adjuster piston is adjusted, by suitable actuation of the 2/3-way valve, between a first position that opens the relief line and a second position that opens the pressure line. In an alternative embodiment, cell chambers that receive pressurized oil are provided between a driving device and a driven device of the fuel injection pump, whose communication with an oil feed pump or a relief conduit is controlled by a 2/4-way valve. In one position of the 2/4-way valve, fuel is delivered from the oil feed pump to one of the pressure chambers, and taken from the other of the pressure chambers via a relief line. If the position of the 2/4-way valve changes, the delivery and removal of fuel take place in reverse order. Also with this device, in the known version, two different positions of the drive device relative to the driven device can be established. By comparison, it is also necessary, in accordance with the predetermined operating parameters, to set intermediate positions precisely and also adhere to them.

ADVANTAGES OF THE INVENTION

The fuel injection pump according to the invention has the advantage over the prior art that by the embodiment of the valve member of the control valve as a slide, it is possible, with only slight adjusting forces, to control an exact control of the inflow to or outflow from the pressure chamber. In particular by closure of the connecting line by the control collar of the slide, a previously set positioning of the injection adjuster piston can be maintained. By closure of the connecting line, the restoring forces that occur in the respective pump piston pumping stroke of the fuel injection pump and are transmitted by the cam ring to the injection adjuster piston are also intercepted, since the volume that is enclosed by the injection adjuster piston in the cylinder is embodied, with the cooperation of the control valve, as a closed volume, and only a deflection of the injection adjuster piston, within the scope of the elastic compressibility of the enclosed hydraulic column, is realized. At the end of a respective pumping stroke of the pump pistons of the fuel injection pump, the injection adjuster piston assumes the previously desired position, and thus controls the recurring injection onset in the desired exact way. At most, if a change in the injection onset is necessary in the meantime because of correspondingly altered operating parameters, the pressure in the pressure chamber can be varied by opening the pressure chamber to the pressure source or to the relief line. With the aid of the control slide, it is furthermore possible to establish overflow cross sections of different sizes between the connecting line and pressure line or relief line, so that the rate of pressure change in the pressure chamber can be variably high, depending on the triggering of the control valve. The result is highly flexible control, by which as needed a desired fast and a desired major injection onset adjustment can be attained. Advantageously, the adjustment of the valve slide is effected by an electromagnet, which adjusts the valve slide in analog fashion or proportionately to a control value. In an alternative version, the control slide can also be triggered in clocked fashion, which lessens the friction of repose, which counteracts adjustment, upon a deflection out of relatively long-maintained steady positions of the valve slide.

Because the cam slide has two collars, that is, a control collar and guide collar, the can slide is acted upon hydraulically in the axial direction by forces of equal magnitude, so that the slide is displaced by the electromagnet solely counter to the force of a restoring spring, in accordance with claim 3. In an advantageous refinement both the pressure chamber that is located on one face end of the injection adjuster piston and a second pressure chamber, which is located on the opposite face end of the injection adjuster piston, are acted upon continuously with pressure fluid by means of the control valve, in that the pressure in these pressure chambers, given a suitable design of the control valve slide, is controlled in complementary fashion by control of the flow of pressure fluid. The control slide is advantageously equipped with two control collars, which in a middle position close the respective connecting lines between the control valve and the pressure chambers on the injection adjuster piston, so that the injection adjuster piston assumes a neutral position, which has been preset beforehand by the appropriate triggering of the control valve. If operating parameters change, then a fast, efficient adjustment of the injection adjuster piston can be brought about by delivering pressure fluid to one pressure chamber and removing pressure fluid from the other pressure chamber. In this case, the speed of adjustment of the injection adjuster piston can also be increased.

It is common to all the exemplary embodiments that the delivery of pressure fluid can be made directly into the pressure chambers, without radially stressing the injection adjuster piston. This reduces the frictional forces and wear of the injection adjuster piston and its guide and assures a long service life. Because of the direct feeding in of pressure fluid and a re-closure of the pressure chambers by the control slide, a minimum demand for pressure fluid is adhered to. High adjustability is possible even at low rpm of the fuel injection pump, which drives a pressure fluid pump in accordance with this rpm, since the outflow losses are minimized. Particularly in a version in which in one of the pressure chambers, in addition to the feeding in of pressure fluid, a restoring spring is also provided, the injection adjuster piston can assume a preferential position for the injection onset adjustment even while the pressure fluid feed quantities are not yet ready, and engine starting is correspondingly promoted as a result. In this position, the pressure chambers are advantageously closed by the control slide, and the injection onset adjuster piston has moved into the aforementioned preferential position under the influence of this spring and enabled by the leakage losses at the circumference of the injection adjuster piston.

In an especially advantageous way, it is possible to make a recess in the injection adjuster piston, which allows a coupling part, which is connected to the cam drive, to be introduced so far into the injection adjuster piston that the contact face between the coupling part and the injection adjuster piston is located in a region that is substantially in the injection adjuster piston axis. The restoring forces of the cam drive are thus directed axially to the injection adjuster piston, and exposure of the injection adjuster piston to tilting moments is averted. In an advantageous refinement according to claim 11, the contact face can be disposed slightly offset from the injection adjuster piston axis, which has the advantage that in this way an automatic self-alignment of the injection adjuster piston with the coupling part is assured, so that the axis of the recess remains set substantially in coincidence with the axis of the coupling part.

BRIEF DESCRIPTION OF THE DRAWINGS

Two exemplary embodiments of the invention are shown in the drawings and will be described in further detail below. Shown are FIG. 1, a first exemplary embodiment having only one pressure chamber triggered by the control valve, and FIG. 2, a second exemplary embodiment, with two pressure chambers triggered by the control valve in complementary fashion to one another.

DETAILED DESCRIPTION

Figure 1:
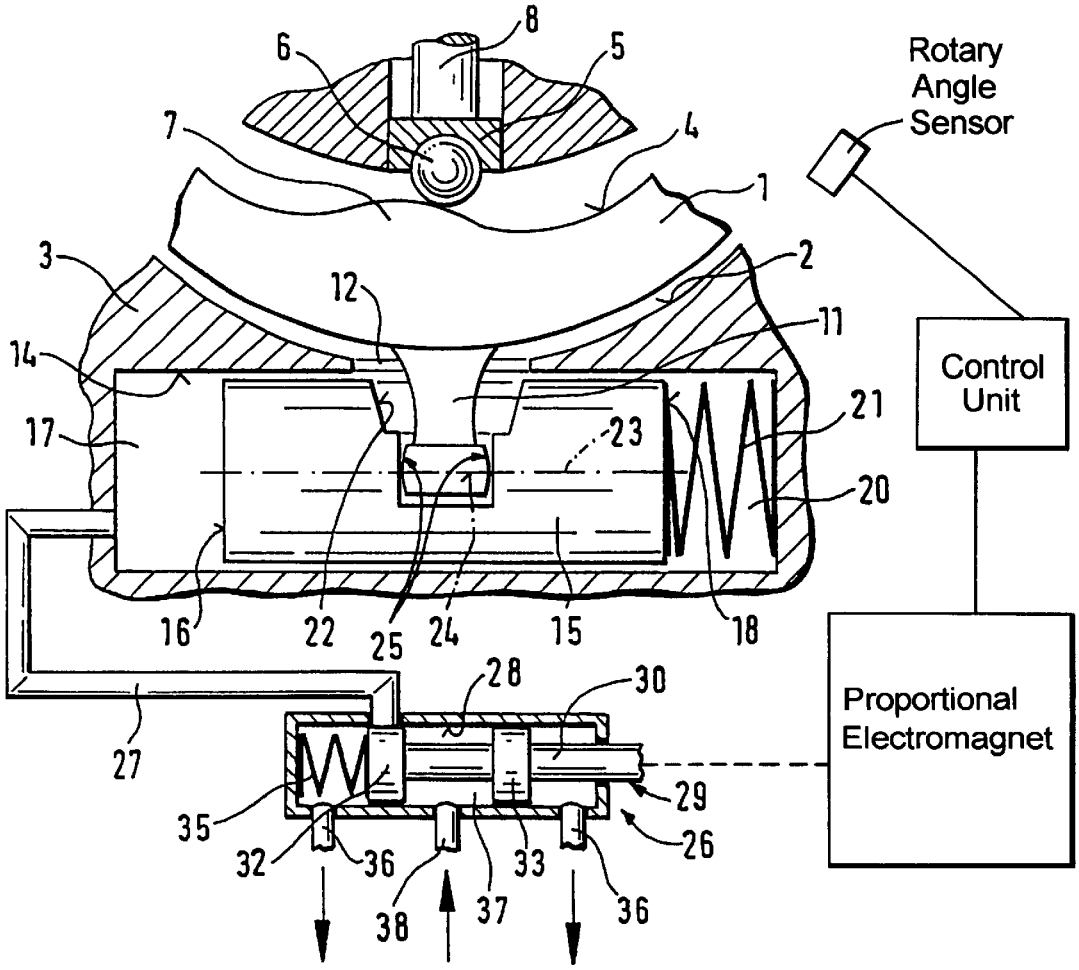

The cam drive of a fuel injection pump has a cam race, in a known manner, on which rollers roll; in this rolling process, relative motion is generated, by which the pump pistons are set into a reciprocating motion. In a reciprocating piston pump, this is a cam disk, and in a radial piston pump it is for example a cam ring 1, as shown in suggested fashion in FIG. 1. This cam ring is rotatably supported in a circular recess 2 in the housing of the fuel injection pump. Pointing inward, toward the axis of the circular recess 2, the cam ring 1 has a cam race 4, on which rollers 6 supported in a roller shoe 5 roll and in the process transmit radial motions, caused by the cams 7 of the cam race, to the pump pistons 8, only one of which is shown here.

For actuation of the cam ring 1 in its circumferential direction or to set a rotary position of the cam ring, a coupling part 11 is provided, in the form of a radially protruding peg embodied integrally with the cam ring; this peg protrudes through an opening 12 in the wall of the circular recess 2 into a cylinder 14, disposed in the housing 3 of the fuel injection pump, and is coupled there to an injection adjuster piston 15 that is longitudinally displaceable in the cylinder 14. The injection adjuster piston 15 has a first face end 16, which together with the closed end of the cylinder 14 encloses a first pressure chamber 17, and on its opposite end it has a second face end 18, which together with the closed end of the cylinder 14 there encloses a second, pressure-relieved pressure chamber 20. A compression spring 21, which urges the injection adjuster piston 15 axially in the direction of a preferential position, is fastened between the closed end of the cylinder 14 and the second face end 18.

The coupling between the coupling part 11 and the injection adjuster piston 15 is effected via a radially oriented recess 22 in the injection adjuster piston 15, in the region of its middle jacket face. This recess is deep enough that the coupling part 11 protrudes into the region of the longitudinal axis 23 of the injection adjuster piston, where its headlike end has a line of contact 24 where contact faces 25 contact the cylindrical portion of the recess surrounding it.

Adjusting forces which are transmitted circumferentially by the pump piston 8 to the cam ring via the cams 7 and in the cam ring are transmitted in turn longitudinally to the adjusting piston 15, thus engage the injection adjuster piston 15 axially, which accordingly prevents the piston from being exposed as a result of these forces to tilting motions, which would lead to unilateral wear of the jacket contact faces with the cylinder 14. The line of contact can either be aligned substantially with the injection adjuster piston or can be radially offset slightly from the adjuster piston, for instance by 2–6 mm from this axis. This has the advantage that a slight torque acts circumferentially on the injection adjuster piston in such a way that the recess 22 is aligned coaxially with the coupling part 11, and thus a preferential position of the pump piston is automatically maintained without requiring additional guide means.

For actuation of the injection adjuster piston, a pressure fluid source, not further shown here, is provided; by way of example, it may be the fuel supply pump of the fuel injection pump, which as a function of rpm pumps fuel into a suction chamber of the fuel injection pump, from which the fuel to be injected is then carried into the pump work chambers, where it is compressed and is then exported for injection through the pump pistons 8 to the injection valves. The intrinsically rpm-dependent pressure that the feed pump, which pumps as a function of rpm, generates can also bring about rpm-dependent control events. To that end, the pressure is controlled more exactly by further pressure valves and is now also available as an adjusting medium for injection onset adjustment. The fuel pressure is fed via a control valve 26 to the first pressure chamber 17, via a connecting line 27. This line discharges directly into the pressure chamber 17, without the inflowing fuel generating any radial force and tilting moments on the injection adjuster piston 15 and thus loading the injection adjuster piston solely axially by this hydraulic force, counter to the force of the compression spring 21. On the other end, the connecting line 27 discharges into a valve cylinder 28, in which a control slide 29 is disposed in displaceable fashion. The control slide, on a shaft 30, has two collars: a first collar in the form of a control collar 32, and a second collar in the form of a guide collar 33. The control collar 32 is seated on the end of the shaft 30 and is loaded on its axial face end by a restoring spring 35, which is braced on the closed face end of the valve cylinder 28 and is located in a chamber that is relieved by a relief line 36. Between the control collar 32 and the guide collar 33, there is an annular chamber 37, which is in constant communication via a pressure line 38 with the aforementioned pressure fluid source, that is, the suction chamber of the fuel injection pump. On the side of the guide collar 33 remote from the annular chamber 37, a further chamber is enclosed, which is also pressure-relieved by a relief line 36. On this side, the shaft 30 leads out of the valve cylinder and is there connected to the armature of a proportional electromagnet, not otherwise shown here, which depending on the current supplied to it effects an adjustment of the control slide 29 counter to the force of the restoring spring 35. In the outset position shown, the control collar 32 has closed the entrance of the connecting line 27 into the valve cylinder 28. In this chamber, a certain pressure has been established, which is counteracted by the force of the compression spring 21, so that the adjusting piston 15 assumes a resultant position of force equilibrium.

If the setting of the pressure adjusting piston is to be changed from the position shown, then the control slide 29 is actuated, for instance to the left, so that fuel from the pressure line 38 can flow via the annular chamber 37 into the connecting line 27 and can increase the pressure in the first pressure chamber 17, until a force equilibrium again exists with the compression spring 21. This adjustment is advantageously monitored by a sensor, which detects the adjustment position of the cam ring 1 and outputs a signal to a control unit, which compares this signal with a set-point value and outputs a corresponding control signal to the proportional magnet of the control valve, which moves the control slide into the position required for the appropriate adjustment of the adjusting piston.

An adjustment of the control slide 29 to the right relieves the first pressure chamber 17, so that under the influence of the now-reduced pressure and the prestressed force of the compression spring 21, the adjusting piston again moves to the left until a force equilibrium is again established at it. This adjustment is again detected by the rotary angle sensor, shown schematically in FIG. 1. The control can also be influenced by still other parameters that are definitive for the injection onset adjustment.

This version has the advantage that the inflow speed of pressure fluid can be varied by the degree to which the connecting line from the annular chamber 37 to the first pressure chamber 17 is opened. If the inflow cross section is large, the injection adjuster piston can be adjusted correspondingly fast, and furthermore, by an exact feedback of the injection onset adjustment outcome, a desired position of the injection adjuster piston can be set exactly by the engagement of the electromagnet with the control slide 29, via the proportional magnet. Actions in the intermediate range resulting from pumping operations of the pump pistons 8 are intercepted by closing the connecting line 27. The injection onset adjusting device is simple in design and easy to realize and has the advantage of a force equilibrium at the injection adjuster piston with the avoidance of radial forces. Because frictional forces are only slight, a long service life of the injection adjuster piston is attained.

Figure 2:
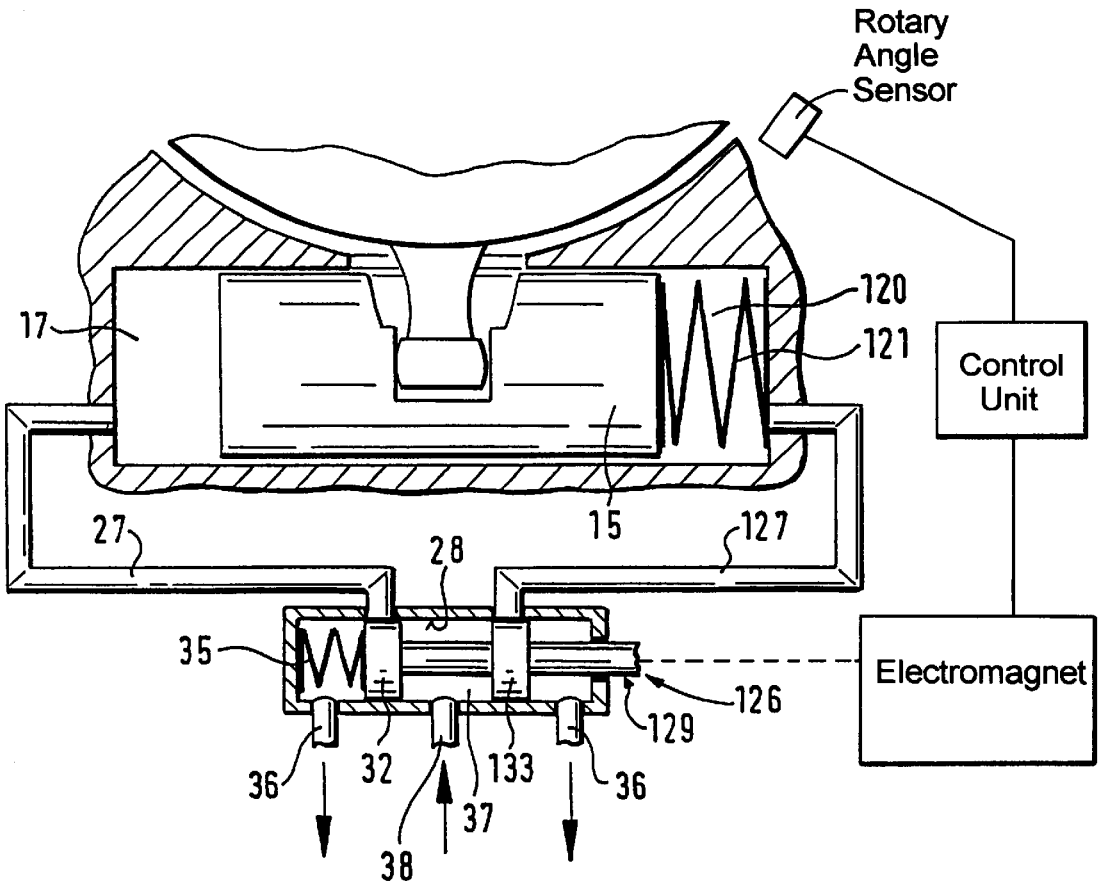

In a further refinement of the invention shown in FIG. 2, a control slide 129 is now provided, which in principle is similar in structure to the control slide of FIG. 1. However, here both collars serve as control collars. There is still the control collar 32 adjacent to the compression spring 35, and the collar previously serving as a guide collar is now a control collar 133. Once again, the inflow of pressure fluid takes place via the pressure line 38 centrally on the jacket face of the valve cylinder 28 into the annular chamber 37, which upon imposition of pressure acts upon the control slide 129 with force equilibrium. The faces of the two collars exposed to pressure are of equal size. While the first control collar 32, as in the exemplary embodiment of FIG. 1, controls the first connecting line 27 into the first pressure chamber 17, the second control collar 133 now controls a second connecting line 127 into the second pressure chamber 120, which now is no longer fundamentally pressure-relieved. In the neutral position shown, the control collars 32 and 133 close the respective orifices of the connecting lines 27 and 127 into the valve cylinder 28. The two pressure chambers 17 and 120 are thus hydraulically locked, and the position of the injection adjuster piston 15 is fixed. The compression spring 121 can now be operative only in the region of a position of the injection adjuster piston that goes beyond a preferential position.

For adjusting the injection adjuster piston, the control slide 129 is now again actuated, for instance by a proportional magnet, for instance toward the left counter to the force of the spring 35. This establishes a communication between the annular chamber 37 and the first pressure chamber 17, so that pressure fluid can reach the first pressure chamber 17. At the same time, by the second control collar 133, the connecting line 127 to the relief line 36 is opened, so that pressure fluid can escape from the second pressure chamber 120. This creates an imbalance of forces at the adjusting piston to a pronounced extent, so that this piston moves very fast to the right, until such time as a certain position of the injection adjuster piston 15 is fixed by means of a correction of the position of the control slide 129. This process is likewise regulated via a control loop, in which the injection onset adjustment angle is looked for, and in accordance with the deviation from a predetermined set-point value, the proportional magnet now actuates the opening of the connecting lines 27,127 or is set to close them. For a reverse order of motion of the injection adjuster piston to the left, the control slide 129 is moved to the right, so that pressure fluid can flow via the connecting line 127 into the second pressure chamber 120, and at the same time pressure fluid can flow out of the first pressure chamber 17 via the connecting line 27 to the relief line 36. This continues until such time as the control slide 127, by way of feedback, is returned to the position that locks the connecting lines 27, 127.

Instead of being adjusted proportionately, the control slide 29 or 129 can also be adjusted in clocked fashion, with a pulse train that acts on the electromagnet and thus generates a quasi-analog adjustment of its armature, which in turn is coupled to the control slide. In this way, slight axial vibration can be generated, which assures that the control slide is constantly in motion, and which maximally avoids hysteresis that would be caused by frictional forces.

With the compression spring 121, it can be attained that while pressure fluid is still lacking, for instance when the engine that is supplied with fuel by the fuel injection pump is and by which the fuel injection pump is driven, a preferential position can be set. Upon starting, the pressure chambers 17 and 120 are hydraulically locked, as shown in FIG. 2. The compression spring 121 can nevertheless move the injection adjuster piston 15 into a preferential position, because of a leakage flow along the jacket face of the injection adjuster piston.

When engine operation begins, at even very low rpm, fuel pressure is already available, although with a feed volume that at first increases only gradually. By the embodiment of the invention, which makes it possible to lock the pressure chambers hydraulically via the control valve, only the slightest quantities of hydraulic fluid or pressure fluid, in the present case fuel, are necessary for achieving the desired setting of the injection onset adjusting piston. Thus the operability of the injection onset adjuster is guaranteed even at low rpm, at an overall very slight effort and expense for control and with a long expected service life, because radial loads on the injection adjuster piston are avoided.

The foregoing relates to a preferred exemplary embodiments of the invention, it being understood that other variants and embodiments thereof are possible within the spirit and scope of the invention, the latter being defined by the appended claims.

We claim:

1. A fuel injection pump comprising a cam drive (1, 5, 6) for reciprocating pump pistons (8), an injection adjuster piston (15), that serves the purpose of injection onset adjustment and acting on the cam drive, the injection adjuster piston is adjustable counter to a restoring force (21) by pressure controlled by a control valve (26, 126), a pressure chamber (17) enclosed in a cylinder (14) by one face end (16) of the injection adjuster piston (15) is used either with a pressure line (38) with a high pressure level or with a relief line (36), the control valve (26, 126) has a control slide (29, 129) that is displaceable in a valve cylinder (28) and has a control collar (32, 133) by means of which a connecting line (27, 127), discharging from the valve cylinder (28) to the pressure chamber (17, 120) is either made to communicate with a pressure line (38) leading from a pressure source and discharging into the valve cylinder (28), or with a relief line (36) leading away from the valve cylinder (28), or is closed.

2. The fuel injection pump of claim 1, in which the control slide (29), in addition to the control collar, has a guide collar (33), between which collars an annular chamber (37) is enclosed in the valve cylinder (28), the annular chamber communicates constantly with either the pressure line (38) or the relief line (36).

3. The fuel injection pump of claim 2, in which the control slide (29, 129) is adjustable by an electromagnet counter to the force of a restoring spring (35).

4. The fuel injection pump of claim 2, in which an electromagnet adjusts the control slide in analog fashion in accordance with a control value, counter to the force of the restoring spring.

5. The fuel injection pump of claim 2, in which an electromagnet adjusts the control slide in clocked fashion in accordance with a control value, counter to the force of the restoring spring (35).

6. The fuel injection pump of claim 1, in which an electromagnet is actuated by a closed-loop control device, which detects the injection adjustment parameters and has a feedback member for the injection adjustment position of the cam drive.

7. The fuel injection pump of claim 2, in which an electromagnet is actuated by a closed-loop control device, which detects the injection adjustment parameters and has a feedback member for the injection adjustment position of the cam drive.

8. The fuel injection pump of claim 3, in which the electromagnet is actuated by a closed-loop control device, which detects the injection adjustment parameters and has a feedback member for the injection adjustment position of the cam drive.

9. The fuel injection pump of claim 4, in which the electromagnet is actuated by a closed-loop control device, which detects the injection adjustment parameters and has a feedback member for the injection adjustment position of the cam drive.

10. The fuel injection pump of claim 5, in which the electromagnet is actuated by a closed-loop control device, which detects the injection adjustment parameters and has a feedback member for the injection adjustment position of the cam drive.

11. The fuel injection pump of claim 2, in which the restoring force is a restoring spring (20).

12. The fuel injection pump of claim 2, in which the guide collar is embodied as a second control collar (133), by which a second connecting line (127), discharging into the valve cylinder (28) and leads to a second pressure chamber (120) enclosed by a face end (18) of the injection adjuster piston (15) in the cylinder (14), either communicates with the pressure line (38) connected with a pressure source and discharging into the valve cylinder (28) or with the relief line (36) leading away from the valve cylinder (28) or is closed, and by means of the control collar (32) and the second control collar (133), the pressure chamber (17) and the second pressure chamber (129) are made to communicate, in complementary fashion to one another, with the pressure line (38) or the relief line (36), or both connecting lines (27, 127), in a middle position of the control slide (129), or closed.

13. The fuel injection pump of claim 3, in which the guide collar is embodied as a second control collar (133), by which a second connecting line (127), discharging into the valve cylinder (28) and leads to a second pressure chamber (120) enclosed by a face end (18) of the injection adjuster piston (15) in the cylinder (14), either communicates with the pressure line (38) connected with a pressure source and discharging into the valve cylinder (28) or with the relief line (36) leading away from the valve cylinder (28) or is closed, and by means of the control collar (32) and the second control collar (133), the pressure chamber (17) and the second pressure chamber (129) are made to communicate, in complementary fashion to one another, with the pressure line (38) or the relief line (36), or both connecting lines (27, 127), in a middle position of the control slide (129), or closed.

14. The fuel injection pump of claim 4, in which the guide collar is embodied as a second control collar (133), by which a second connecting line (127), discharging into the valve cylinder (28) and leads to a second pressure chamber (120) enclosed by a face end (18) of the injection adjuster piston (15) in the cylinder (14), either communicates with the pressure line (38) connected with a pressure source and discharging into the valve cylinder (28) or with the relief line (36) leading away from the valve cylinder (28) or is closed, and by means of the control collar (32) and the second control collar (133), the pressure chamber (17) and the second pressure chamber (129) are made to communicate, in complementary fashion to one another, with the pressure line (38) or the relief line (36), or both connecting lines (27, 127), in a middle position of the control slide (129), or closed.

15. The fuel injection pump of claim 5, in which the guide collar is embodied as a second control collar (133), by which a second connecting line (127), discharging into the valve cylinder (28) and leads to a second pressure chamber (120) enclosed by a face end (18) of the injection adjuster piston (15) in the cylinder (14), either communicates with the pressure line (38) connected with a pressure source and discharging into the valve cylinder (28) or with the relief line (36) leading away from the valve cylinder (28) or is closed, and by means of the control collar (32) and the second control collar (133), the pressure chamber (17) and the second pressure chamber (129) are made to communicate, in complementary fashion to one another, with the pressure line (38) or the relief line (36), or both connecting lines (27, 127), in a middle position of the control slide (129), or closed.

16. The fuel injection pump of claim 6, in which the guide collar is embodied as a second control collar (133), by which a second connecting line (127), discharging into the valve cylinder (28) and leads to a second pressure chamber (120) enclosed by a face end (18) of the injection adjuster piston (15) in the cylinder (14), either communicates with the pressure line (38) connected with a pressure source and discharging into the valve cylinder (28) or with the relief line (36) leading away from the valve cylinder (28) or is closed, and by means of the control collar (32) and the second control collar (133), the pressure chamber (17) and the second pressure chamber (129) are made to communicate, in complementary fashion to one another, with the pressure line (38) or the relief line (36), or both connecting lines (27, 127), in a middle position of the control slide (129), or closed.

17. The fuel injection pump of claim 11, in which the guide collar is embodied as a second control collar (133), by which a second connecting line (127), discharging into the valve cylinder (28) and leads to a second pressure chamber (120) enclosed by a face end (18) of the injection adjuster piston (15) in the cylinder (14), either communicates with the pressure line (38) connected with a pressure source and discharging into the valve cylinder (28) or with the relief line (36) leading away from the valve cylinder (28) or is closed, and by means of the control collar (32) and the second control collar (133), the pressure chamber (17) and the second pressure chamber (129) are made to communicate, in complementary fashion to one another, with the pressure line (38) or the relief line (36), or both connecting lines (27, 127), in a middle position of the control slide (129), or closed.

18. The fuel injection pump of claim 2, in which the annular chamber (37) communicates constantly with the pressure line (38).

19. The fuel injection pump of claim 1, in which the injection adjuster piston (15) has a central axis and a recess (22) in a jacket face, the recess is engaged by a coupling part (11) connected to the cam drive, wherein the coupling part has a contact face, and the point where contact face (25) contacts the injection adjuster piston (15) is located substantially in a region of the injection adjuster piston central axis (23).

20. The fuel injection pump of claim 2, in which the injection adjuster piston (15) has a central axis and a recess (22) in a jacket face, the recess is engaged by a coupling part (11) connected to the cam drive, wherein the coupling part has a contact face, and the point where contact face (25) contacts the injection adjuster piston (15) is located substantially in a region of the injection adjuster piston central axis (23).

21. The fuel injection pump of claim 1, in which the injection adjuster piston (15) has a central axis and a recess (22) in a jacket face, the recess is engaged by a coupling part (11) connected to the cam drive, wherein the coupling part has a contact face, and the point where contact face (25) contacts the injection adjuster piston (15) is located offset by approximately 2–6 mm away from the injection adjuster piston central axis (23).

* * * * *

UNITED STATES PATENT AND TRADEMARK OFFICE

CERTIFICATE OF CORRECTION

PATENT NO. : 6,413,054 B1 
DATED : July 2, 2002
INVENTOR(S) : Wolfgang Geiger et al.

It is certified that error appears in the above-identified patent and that said Letters Patent is hereby corrected as shown below:

Title page,
Item [30], should read as follows:
-- [30] Foreign Application Priority Data
November 27, 1998 (DE) ……. 198 54 766 --

Signed and Sealed this

Fifteenth Day of October, 2002

*Attest:*

*Attesting Officer*

JAMES E. ROGAN
*Director of the United States Patent and Trademark Office*